US005586502A

United States Patent [19]

Weber

[11] Patent Number: 5,586,502

[45] Date of Patent: Dec. 24, 1996

[54] APPARATUS FOR INSTALLING AND REMOVING RAIL CLIPS

[75] Inventor: Robert M. Weber, Ingleside, Ill.

[73] Assignee: Nordco Inc., Milwaukee, Wis.

[21] Appl. No.: 403,635

[22] Filed: Mar. 14, 1995

[51] Int. Cl.[6] ..... E01B 29/24

[52] U.S. Cl. ..... 104/17.2; 104/2

[58] Field of Search ..... 104/2, 7.2, 9, 17.1, 104/17.2, 307

[56] References Cited

U.S. PATENT DOCUMENTS

| | | | |
|---|---|---|---|
| 4,319,392 | 3/1982 | Cutts | 29/402.08 |
| 4,494,463 | 1/1985 | Young et al. | 104/307 X |
| 4,579,061 | 4/1986 | Dieringer | 104/17 |
| 4,580,501 | 4/1986 | Collins et al. | 104/1 |
| 4,777,885 | 10/1988 | Dieringer | 104/17.1 |
| 5,003,888 | 4/1991 | Martin | 104/17.2 |
| 5,191,838 | 3/1993 | Hansen | 104/17.2 X |
| 5,269,225 | 12/1993 | Bosshart et al. | 104/17.2 X |
| 5,398,616 | 3/1995 | Eidemanis et al. | 104/17.2 |
| 5,431,107 | 7/1995 | Almaraz et al. | 104/17.2 X |
| 5,774,219 | 12/1991 | Theurer et al. | 104/17.2 |

FOREIGN PATENT DOCUMENTS

| | | | |
|---|---|---|---|
| 219515 | 3/1985 | Germany | 104/17.2 |
| 6173206 | 6/1994 | Japan | 104/2 |

OTHER PUBLICATIONS

Nordco: Anchor Remover (CSX) videotape, Apr. 20, 1993.

Progressive Railroading's Track Yearbook & Buyers' Guide, Rail Fastener Applicators/Removers, pp. 193 and 194, 1994–95 Track Yearbook.

Pandrol Fastclip Brochure; Pandrol, Inc., date unknown.

*Primary Examiner*—Robert J. Oberleitner
*Assistant Examiner*—Kevin D. Rutherford
*Attorney, Agent, or Firm*—Greer, Burns & Crain, Ltd.

[57] ABSTRACT

An apparatus for installing and removing rail clips from a rail, the apparatus constructed and arranged to be mounted on a railway maintenance vehicle having a frame, and including an applicator/remover configured to perform one of installation and removal of the rail clips relative to a rail, an actuator configured for reciprocating the applicator/remover in a direction substantially transverse to the rail so that rail clips are moved one of towards the rail or away from the rail.

13 Claims, 9 Drawing Sheets

APPARATUS FOR INSTALLING AND REMOVING RAIL CLIPS

BACKGROUND OF THE INVENTION

The present invention relates to machines used in performing railway maintenance. More particularly, the present invention relates to machines for installing and removing rail clips from railways.

Conventional railroad tracks generally comprise two rails secured to a plurality of ties by rail fasteners. Depending on the type of material used to make the tie, different fasteners are used. For concrete ties, rail clips are often employed. The clips are usually installed on both the field side and gage side of the rail in order to prevent the rail from slipping. Rail clips are installed by sliding the clips into place in specially designed brackets or fittings embedded in the ties so that a portion of the clip overlaps the base of the rail.

Rail maintenance machines have been built for installing and removing rail clips. These machines are designed to ride on the rails and are provided with lever members for performing the installation and removal. An operator rides on the machine and is responsible for positioning the lever members over the rail clips. Once the lever members are in place, the operator initiates the installation or removal operation.

Generally, rail clips are installed by sliding the clips in shoulders in a direction parallel to the rail. Rail clips which are installed on and removed from the rail by sliding the clips transversely over the rail base are relatively new.

Conventional rail clip machines are configured for installing and removing rail clips which are installed by sliding the clips in shoulders in a direction parallel to the rail and are not suitable for the installation and removal of clips installed by sliding the clips transversely over the rail base.

Thus, there is a need for a machine which can automatically and reliably install and remove rail clips to and from rails, by sliding the clips into and out of shoulders transversely to the rail.

it is an object of the present invention to provide an apparatus for installing and removing rail clips by sliding the clips transversely to the rail.

It is another object of the present invention to provide an apparatus for installing and removing rail clips transversely to the rail in a manner which minimizes stress on the clip support structure.

It is still another object of the present invention to provide an apparatus for installing and removing rail clips which reduces the amount of slippage that occurs during the installation/removal operation, also reducing the number of faulty installation/removal attempts.

It is a further object of the present invention to provide an apparatus for installing and removing rail clips which can be accurately positioned over the rail clips, reducing the number of faulty attempts.

It is a still further object of the present invention to provide an apparatus for installing and removing rail clips which can be used with existing railway maintenance machines.

Other features and advantages of the present invention will be apparent from the following description taken in conjunction with the accompanying drawings.

SUMMARY OF THE INVENTION

In order to meet or achieve the foregoing objects, the present invention provides an apparatus configured for connection to a vehicle for installing and removing rail clips to and from a rail, the rail having a gage side and a field side. The apparatus includes at least one clip applicator/remover, and at least one actuator operably connected to the applicator/remover for reciprocating the applicator/remover in a direction substantially transverse to the rail, so that rail clips may be moved at least one of towards the rail and away from the rail in a transverse direction to the rail. In the preferred embodiment, the present apparatus may be provided in either an applicator mode or a remover mode. In the applicator mode, the apparatus forcefully moves the applicator transversely toward the rail and then retracts. In the remover mode, the apparatus forcefully moves the remover transversely away from the rail and then retracts.

In another embodiment, a rail clip installer is provided which is configured for connection to a vehicle for installing rail clips onto a rail. The rail clip installer includes at least one clip applicator, at least one actuator operably connected to the applicator for reciprocating the applicator relative to the rail; and at least one guide rod operably connected to the actuator between the actuator and the rail for guiding the reciprocation of the actuator, and connected to the applicator for actuating the applicator transverse to the rail.

In yet another embodiment, a rail clip removing apparatus configured for connection to a vehicle for removing rail clips from a rail. The rail clip remover includes at least one clip remover, at least one actuator operably connected to the remover for reciprocating the remover, and at least one guide rod operably connected to the actuator so that the actuator is between the guide rod and the rail for guiding the reciprocation of the actuator, the guide rod being connected to the remover for reciprocally actuating the remover in a direction substantially transverse to the rail.

DESCRIPTION OF THE PREFERRED EMBODIMENT

Figure 1:
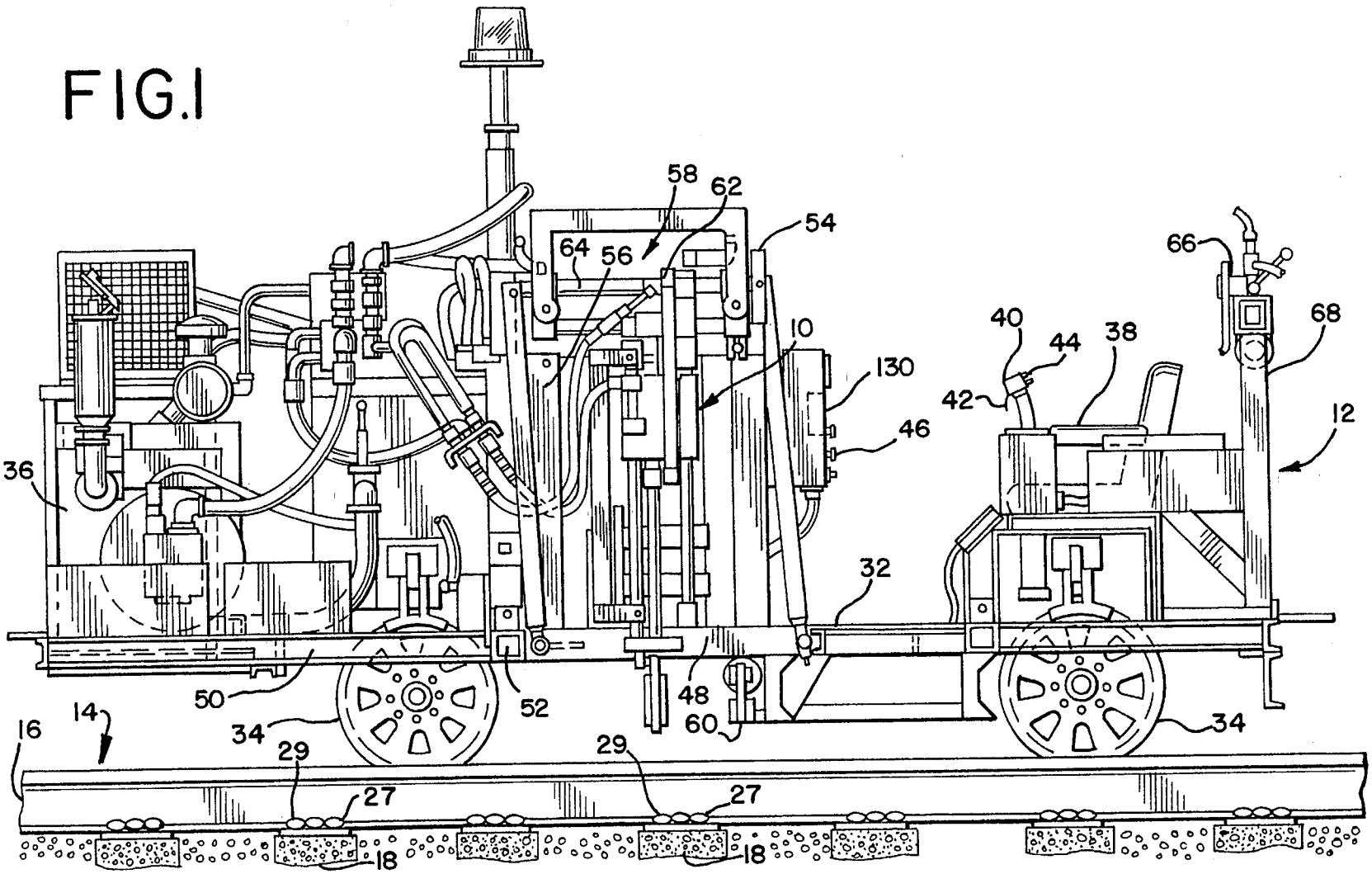
FIG. 1 is a side elevational view of a railway maintenance vehicle of the type suitable for use with the present apparatus for installing and removing rail clips.

Referring now to FIGS. 1–4, the present rail clip installer/remover device is generally designated 10 and is designed for mounting upon a railway maintenance machine or base unit, generally designated 12. The machine 12 is preferably designed to be self-propelled on a railroad track 14, however remote propulsion sources are contemplated. Included on the track 14 is a pair of rails 16 (only one pictured), and a plurality of rail support members commonly referred to as ties 18. It is preferred that the present apparatus be used with concrete ties, in that such ties are more commonly used with rail chips. However, wooden ties are also contemplated. Tie shoulders 20 are embedded in the ties 18 on both the field side 15 and gage side 17 of the rail 16. Rail clips 22 are installed in the tie shoulders 20 to prevent the rails 16 from moving on the ties 18. The rail clips 22 overlap the rail base 24 on both sides of the specified ties 18.

Figure 2:
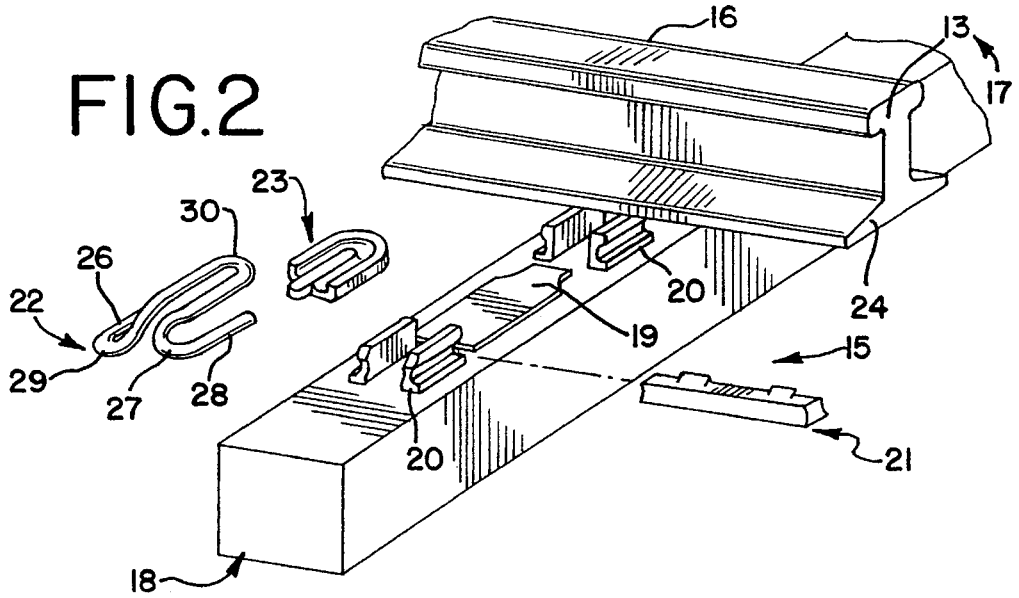
FIG. 2 is an exploded perspective view of the rail, tie, shoulder, rail clip, and pads of the type for which the present apparatus is designed.
Figure 3:
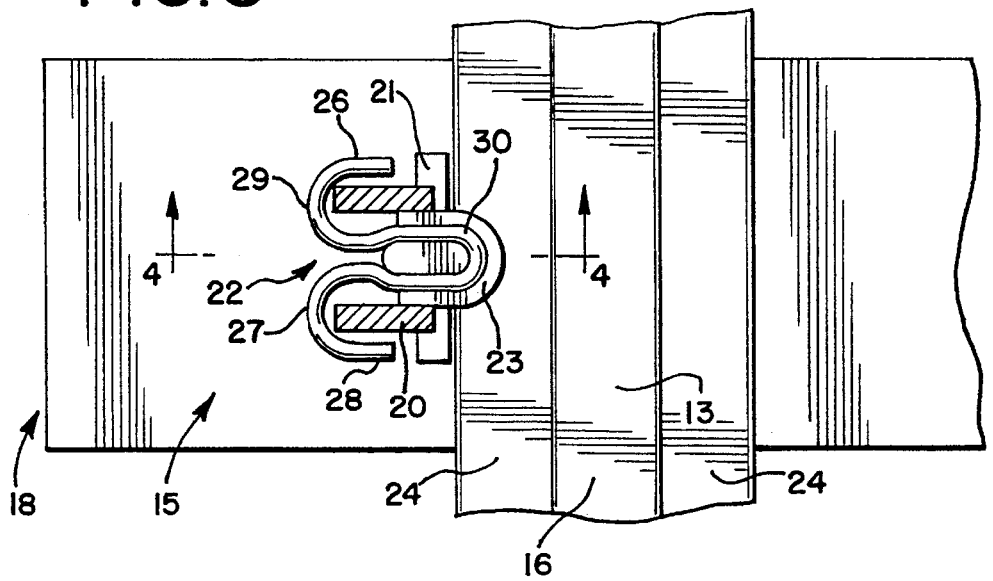
FIG. 3 is an overhead plan view of the rail, tie, shoulder, rail clip and pads depicted in FIG. 2 in assembled fashion.
Figure 4:
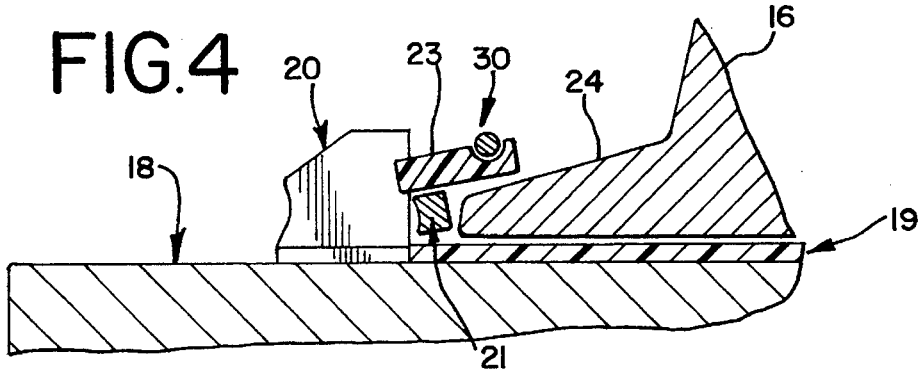
FIG. 4 is a vertical sectional view taken along the line 4—4 of FIG. 3 and in the direction generally indicated.
Figure 5:
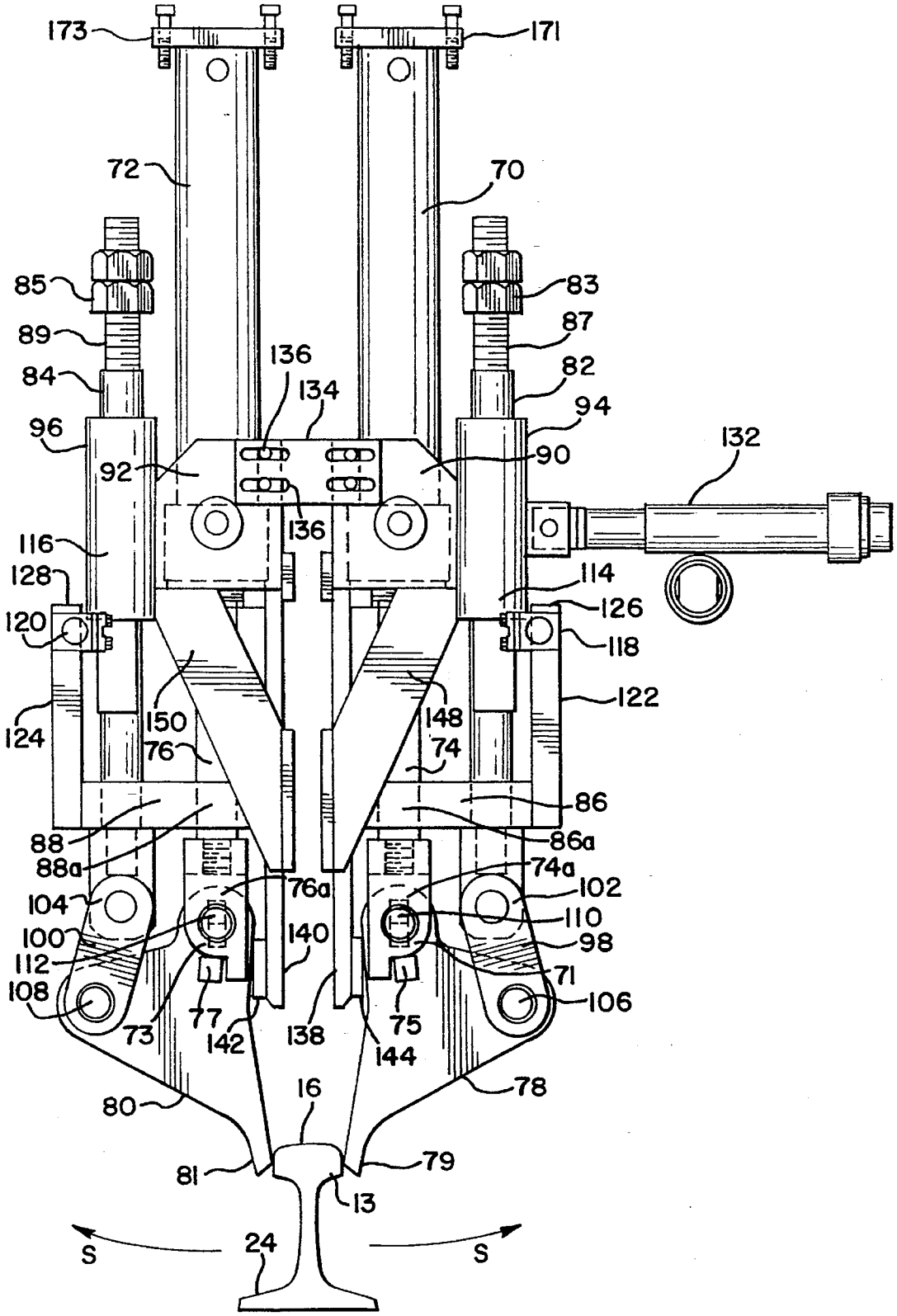
FIG. 5 is a front elevational view of the present rail clip remover.

Referring now to FIGS. 2–4, the rail clips 22 have substantially straight leg portions 26, 28 which each engage a corresponding groove located in each tie shoulder 20, curved knee portions 27 and 29, and a central clip end 30 which engages the rail base 24. A rail pad 19 of resilient material is provided between the rail 16 and the tie 18 for protecting the tie 18 from wear caused by the rail 16. A rail base edge insulator pad 21 is provided between the rail 16 and the tie shoulder 20 for preventing wear between the rail base 24 and the tie shoulder 20. A clip insulator pad 23, configured to engage the central clip end 30 of the rail clip 22, is also provided between the rail clip 22 and the rail base 24 for protecting the rail base 24 and the rail clip 22 from damage. An exemplary clip assembly is manufactured by PANDROL Incorporated, Bridgeport, N.J. and sold under the trademark FASTCLIP.

Referring again to FIG. 1, the base unit 12 includes a frame 32 supported on a plurality of wheels 34 such that the frame can be moved along the rails 16. The frame 32 preferably supports a source of motive power 36 such as an internal combustion engine, which propels the unit 12 and also powers the fluid power system, which in the preferred embodiment is hydraulic. Also supported on the frame 32 is at least one operator's seat 38. At least one of the operator's seats 38 is provided with at least one control joystick 40 having at least one trigger 42 and other functional controls such as actuator buttons 44. The operator's seat 38 and the joystick 40 are located in operation proximity to a central control panel 46.

Included on the frame 32 are a pair of generally parallel main tubes 48. The main tubes 48 are positioned to be approximately parallel to the rails 16 and are fixed at each end to generally rectangular portions 50, each of the latter including a transversely positioned cross tube 52.

A centrally located, elevated portion 54 of the frame 32 is supported by generally vertical columns 56 which are joined at their respective upper ends by horizontal beams (not shown) to define a generally box-shaped operational zone 58. The operational zone 58 is the area within which the present rail clip installer/remover 10 is connected. As is common in such equipment, the frame 32 is optionally provided with a rail clamp 60 which secures the frame 32 to the rail during the installation and removal operations. Such rail clamps are well known in the art, and a suitable example is disclosed in U.S. Pat. No. 4,579,061 which is incorporated by reference.

Located at the top of the elevated portion 54 is a spotting carriage 62 for manipulating the clip installer/remover 10 in the directions both parallel and transverse to the rails 16. The carriage 62 includes at least one fluid power cylinder 64 for controlling movement of the clip installer/remover 10 in each of the parallel and transverse directions. Greater details of the construction and operation of the spotting carriage 62 are disclosed in U.S. Pat. No. 5,398,616 which is incorporated by reference herein. If desired, the frame 32 may also be provided with a winch 66, which in the preferred embodiment is mounted on a rear frame guard member 68 located behind the operator's seat 38. Clip installing/removing devices 10 may be provided on both sides of the railway maintenance machine 12 to simultaneously install/remove rail clips 22 from both rails 16. In instances where both rails 16 are being worked on, additional operators may be required.

Referring now to FIGS. 5 and 6A–6D, the present rail clip remover 10 is shown in greater detail. The rail clip remover 10 is configured to remove the clips from both sides of the rail 16 and includes actuators, which in the preferred embodiment are fluid power cylinders 70 and 72, both of which are preferably hydraulic cylinders, however other sorts of suitable automatic actuators, such as electric or hydraulic motors, or fluid power rotary actuators may be used. Shafts 74 and 76 slidably extend from a lower end of the cylinders 70 and 72 respectively. A pair of clip removers 78 and 80 are pivotally connected to ends of the shafts 74 and 76 by clevis joints **74*a* and 76*a*, respectively, and are constructed and arranged for removing rail clips 22 from engagement with the rail 16. Actually, in the present case, "removal" refers to a sliding of the clip laterally and transversely from the rail base 24. In the preferred embodiment, the removers 78, 80 are configured to have elongated hook ends 79 and 81, opposite the clevis joints 74*a*, 76*a*, for contacting the central clip ends 30. Remover blocks 75 and 77 are provided to abut remover stops 71 and 73 connected to the removers 78 and 80. The remover blocks 75 and 77 are configured to position the hook ends 79 and 81 of the removers 78 and 80 next to the rail 16 and beneath the rail head 13**.

The cylinders 70 and 72 are each connected to the lower end of the spotting carriage 62 by attachment flanges 171 and 173, although it is contemplated that the cylinders may be mounted in a reverse direction so that the shafts 74 and 76 are mounted to the spotting carriage 62. In prior maintenance devices, the attachment flanges 171 and 173 have been a structural weak point for the device 10. During operation, torque forces on the cylinders 70 and 72 cause stress on the flanges 171 and 173 and have been the cause of failures at this point. Generally vertically extending guide rods 82 and 84 are provided for guiding the vertical displacement of the shafts 74 and 76 and for rotating the removers 78 and 80 in a substantially transverse direction to the rails 16. By guiding shaft displacement in the vertical direction, the guide rods 82 and 84 counteract the damaging operational forces to lessen the stress applied to the attachment flanges 171 and 173.

Both guide rods 82 and 84 are disposed in a generally parallel relationship to the cylinders 70 and 72. The guide rods 82 and 84 are connected to the shafts 74 and 76 by guide supports 86 and 88. The guide supports 86 and 88 are provided with throughbores **86*a* and 88*a* through which the shafts 74 and 76 reciprocate. In addition, the guide rods 82 and 84 are connected to the cylinders 70 and 72 by guide brackets 90 and 92. In the preferred embodiment, the guide brackets 90 and 92 are attached to a lower end of the cylinders 70 and 72, and are provided with hollow barrels or sleeves 94 and 96 through which the guide rods 82 and 84** reciprocate. Links 98 and 100 connect the guide rods 82 and 84 to the removers 78 and 80 through pivot pins 102, 104, 106 and 108. The shafts 70 and 72 are connected to the removers 78 and 80 by pivot pins 110 and 112 which engage the clevis joints 74*a*, 76*a* respectively.

Guide rod stops 83 and 85 are provided on the guide rods 82 and 84 for stopping the guide rods 82 and 84 in a "down" position. In the preferred embodiment, the guide rods are configured to have threaded upper sections 87 and 89, and the guide rod stops are threaded nuts configured to screw onto the threaded upper sections 87 and 89. The guide rod stops 83 and 85 are vertically adjustable so that the guide rod "down" position can be adjusted to account for rail height variations.

Provided on the sleeves 94 and 96 are generally vertically extending adjustable slides 114 and 116. The slides 114 and 116, which are basically lengths of "L" bracket, are disposed in a generally parallel relationship to the guide rods 82 and 84. In the preferred embodiment, proximity switches 118 and 120 are mounted on the slides for monitoring and controlling the vertical reciprocation of the shafts 74 and 76 and the guide rods 82 and 84. Generally vertically extending, sensor arms 122 and 124 are attached to the guide supports 86 and 88. The sensor arms 122 and 124 are configured to vertically reciprocate with the shafts 74 and 76, and the guide rods 82 and 84, and are positioned to abut the switches 118 and 120 when the guide rods 82 and 84 are between an uppermost "work up" position (best seen in FIG. 6A) and a slightly lower "ready" position (best seen in FIG. 6B).

Figure 6A:
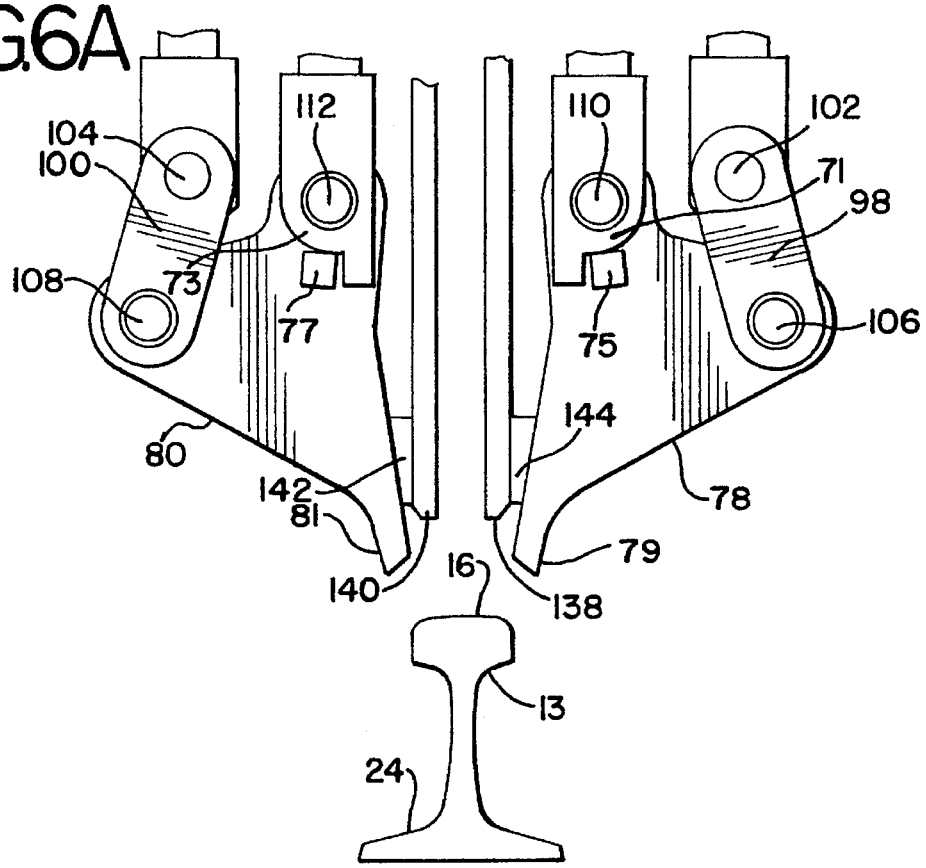
FIGS. 6A–6D are schematic views of a sectional view of a rail with a rail clip illustrating the "work up", "ready" and "down" positions of the remover of the present invention.
Figure 6B:
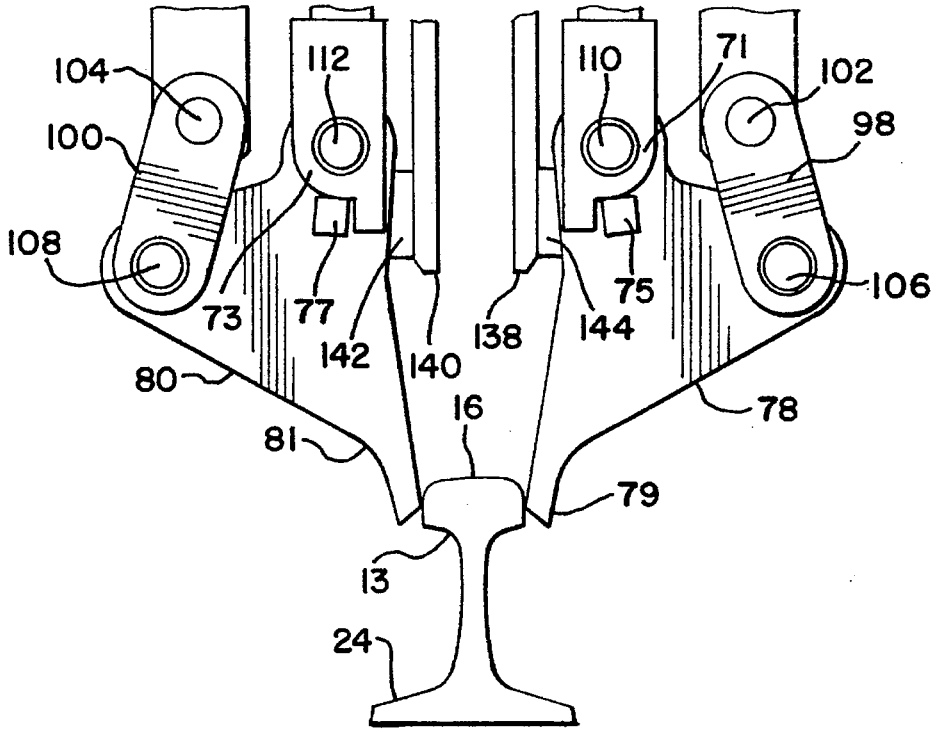
Figure 6C:
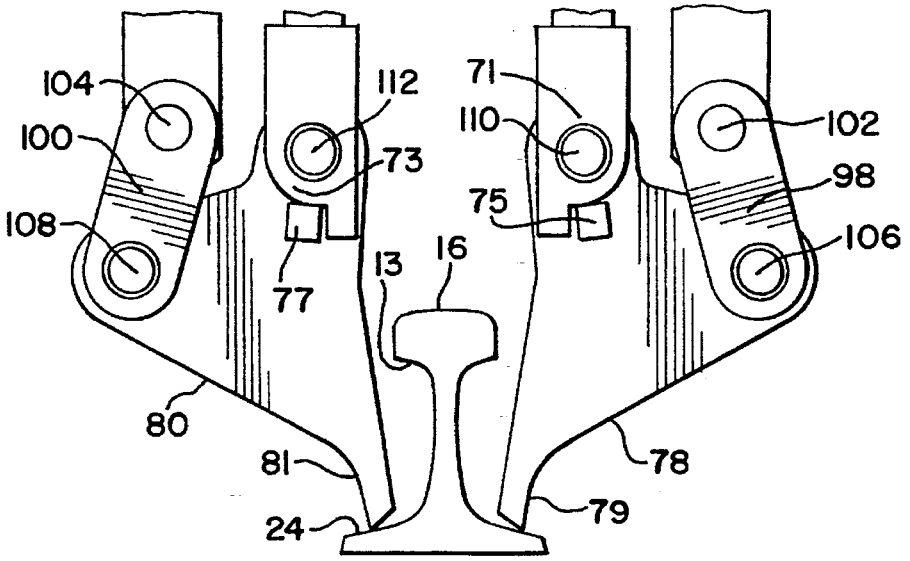
Figure 6D:
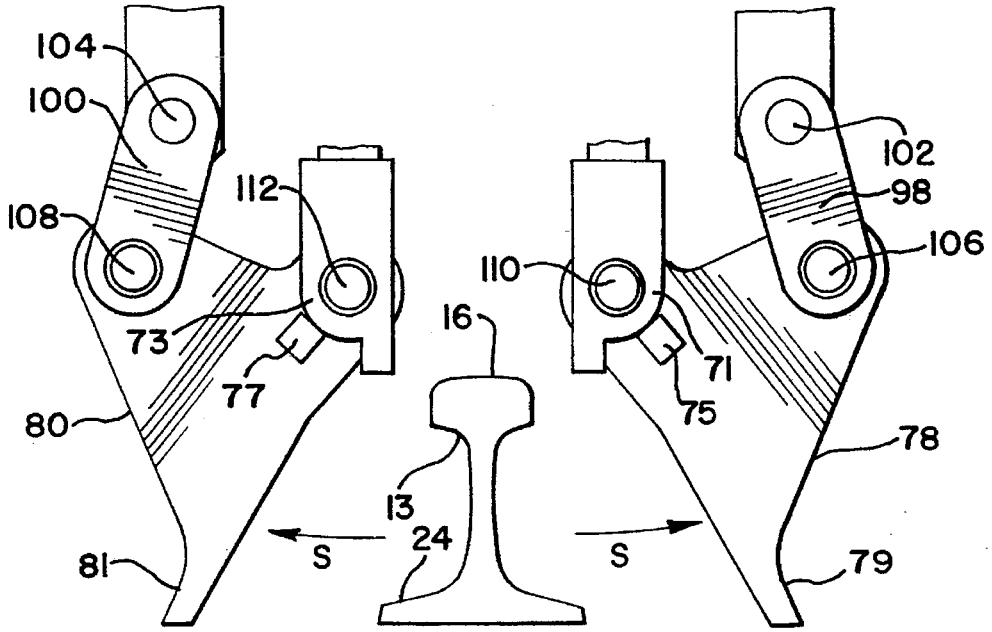

The switches 118 and 120 monitor and control the vertical reciprocation of the shafts 74 and 76 and the guide rods 82 and 84 between the "work up" position and the "ready" position. The switches 118 and 120 monitor the vertical displacement of the sensor arms 122 and 124, which in turn is representative of the vertical displacement of the shafts 74 and 76 as well as of the guide rods 82 and 84. When the upper ends 126 and 128 of the sensor arms 122 and 124 pass the switches 118 and 120, the switches 118 and 120 send a "ready" signal to a master controller 130 (shown hidden in FIG. 1), located in the control panel 46, which stops and holds the shafts 74 and 76 and guide rods 82 and 84 in the "ready" position. By adjusting the slides 114 and 116, it is possible to configure the rail clip remover 10 so that the removers 78 and 80 ride closer to the rail, in the "ready" position as best shown in FIG. 6B. This decreases the amount of time an operator spends positioning the removers 78 and 80 between the "ready" and "down" positions.

Although the preferred embodiment employs proximity switches 118 and 120, it is contemplated that mechanical limit switches or other equivalent position sensors may be employed.

A stabilizer bracket 132 is connected to the slide 94 positioned on the gage side 17 of the rail 16 to provide additional stabilization for the shafts 74 and 76. Such stabilizer brackets are well known in the art, and a suitable example is disclosed in commonly assigned U.S. Pat. No. 4,777,885 issued Oct. 18, 1988, which is incorporated by reference. A stabilizer plate 134 connects the cylinder brackets 90 and 92. In the preferred embodiment, the stabilizer plate 134 is provided with a plurality of elongated mounting slots 136 to accommodate relative variations in the position of the cylinders 70 and 72.

Generally vertically extending deflector plates 138 and 140 are connected to the cylinders 70 and 72 and to the stabilizer plate 134. The deflector plates 138 and 140 extend downward from the stabilizer plate 134 and are attached at the lower end of the deflector plates 138 and 140 to deflector blocks 142 and 144. The deflector blocks are configured to prevent the removers 78 and 80 from crossing, or becoming hooked on, the rail 16. Angled deflector plate supports 148 and 150 are provided for securing the deflector plates 138 and 140 in position. The deflector plate supports 148 and 150 are connected to the guide brackets 90 and 92 and the deflector plates 138 and 140.

In operation, and referring to FIGS. 1 and 6A–6D, the railway maintenance machine 12 is driven into position by the operator. The rail clip remover 10, in the "work up" position is positioned over a rail clip 22 using the joystick 40 to adjust the position of the spotting carriage 62. When the rail clip remover 10 is in place, the operator places the shafts 74 and 76 and guide rods 82 and 84 into the "ready" position by triggering the hand controller trigger 42.

The proximity switches 118 and 120 monitor and control the disposition of the shafts 74 and 76 and the guide rods 82 and 84 between the "work up" position (best shown in FIG. 6A) and the "ready" position (best shown in FIG. 6B). This is accomplished by reading magnetic fields created by the sensor arms 122 and 124. The switches 118 and 120 sense when the upper ends 126 and 128 of the sensor arms 122 and 124 pass the switches 118 and 120. When the switches 118 and 120 detect the upper ends 126 and 128 of the sensor arms 122 and 124, the switches 118 and 120 send a "ready" signal to the master controller 130 which stops and holds the shafts 74 and 76 and the guide rods 82 and 84 in the "ready" position.

Once the rail clip remover 10 is in the "ready" position, its position may again be adjusted using the joystick 40 to adjust the position of the spotting carriage 62. When the operator is satisfied that the rail clip remover 10 is properly positioned, he initiates the removal operation by actuating one of the buttons 44 on the joystick 40, which causes the cylinders 70 and 72 to extend the shafts 74 and 76 and guide rods 82 and 84 into the "down" position. During this portion of the clip removal operation, in applications where a rail clamp 60 is provided, the rail clamp secures the frame 32 to the rail 16.

The guide rods 82 and 84 reach a lowermost "down" position (best shown in FIG. 6C) when the guide rod stops 83 and 85 contact the sleeves 94 and 96, stopping the guide rods 82 and 84. At this point the shafts 74 and 76 continue to move vertically downward to their eventual lowermost "down" position (best shown in FIG. 6D).

The links 98 and 100 are configured to cause the removers 78 and 80 to be actuated in the relatively flat arc S in a direction away from the rail 16, when the guide rods 82 and 84 are in the stopped "down" position and the shafts 74 and 76 continue downward past the guide rod stopping point. The hook ends 79 and 81 of the removers 78 and 80 are configured to come into contact with the central clip ends 30 of the clips 22, forcing the clips 22 transversely away from, and out of engagement with, the rail base 24. When the hook ends 79 and 81 of the removers 78 and 80 contact the shoulders 20, the removal operation is complete. If desired, a suitable pressure switch (not shown) may be provided to sense the contact between the hook ends 79 and 81 with the shoulders 20. Upon the exertion of a predesignated pressure by the hook ends, the switch would shut off the further extension of the shafts 74, 76 from the cylinders 70, 72.

After the rail clips 22 have been removed, the shafts 74 and 76 and the guide rods 82 and 84 are retracted to the "ready" position, and the rail clamp 60 is released from the rail 16. The operator then repositions the railway maintenance machine 12 over the next set of rail clips 22 to repeat the clip removal operation.

In order to speed the removal of rail clips 22, it is contemplated that in some applications two rail clip removers 10 may be provided on each side of the railway maintenance machine 12 so that the rail clips 22 on both sides of a tie 18 may be removed simultaneously.

Figure 7:
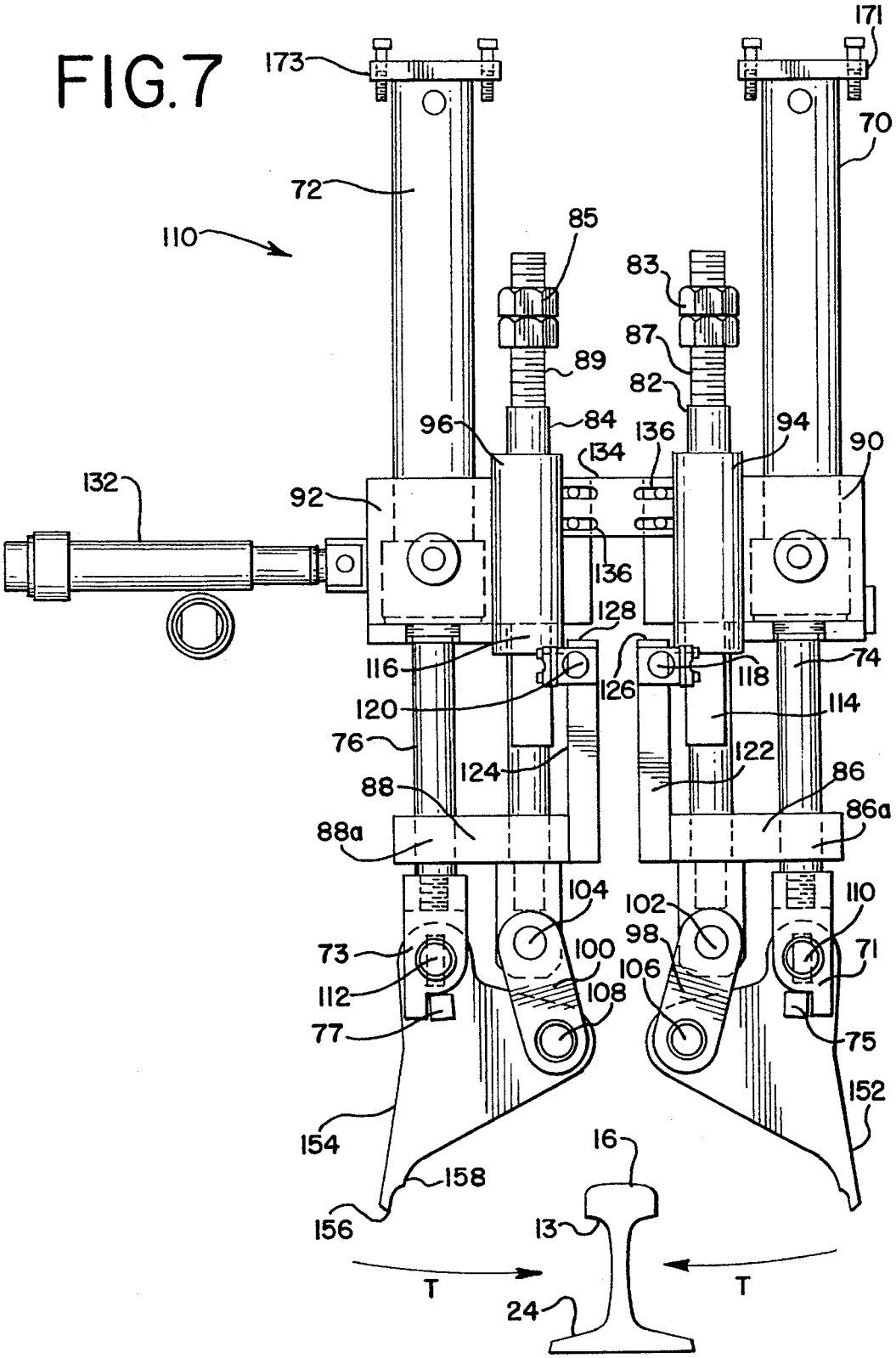
FIG. 7 is a front elevational view of the present rail clip installer.

Referring now to FIG. 7, FIGS. 8A–8C and FIGS. 9A–9D, the present rail clip installer 110 is shown in greater detail. The construction and operation of the rail clip installer 110 is substantially the same as the rail clip remover 10 described above. As such, identical components have been designated with identical reference numerals. However, as shown in FIG. 7, the positioning of the shafts 74 and 76 and guide rods 82 and 84 relative to each other and to the rail is reversed, with the guide rods 82 and 84 being positioned on the rail side of the shafts 74 and 76.

In this configuration, the applicators 152 and 154 are actuated in the generally flat arc T in a direction towards and substantially transverse to the rail 16. In this manner, the applicators 152 and 154 are configured to contact the knee portions 27, 29 of the rail clip 22 and to slide the rail clips 22 transversely into position in the shoulders 20 and into engagement with the rail base 24. As such, in the preferred embodiment, "application" or "installation" of clips refers to a sliding movement of the clip transverse to the rail so that the clip engages the rail base 24. Because the applicators 152 and 154 move towards the rail 16 during the installation operation, there is no need for the deflector blocks 146 and 144, the deflector plates 138 and 140, or the deflector plate supports 148 and 150 of the rail clip remover.

Figure 8A:
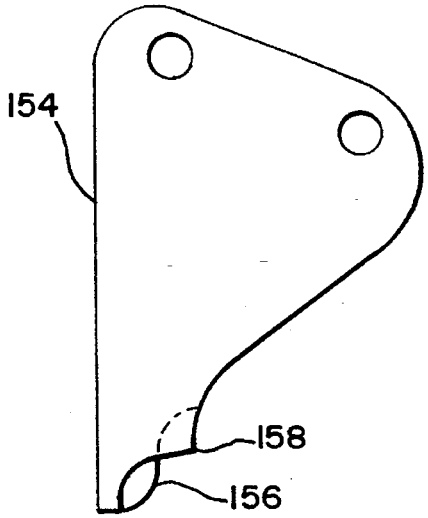
FIG. 8A is an isolated side view of a clip applicator with a recessed pocket.
Figure 8B:
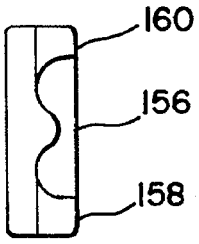
FIG. 8B is an underside elevational view of the applicator depicted in FIG. 8A.
Figure 8C:
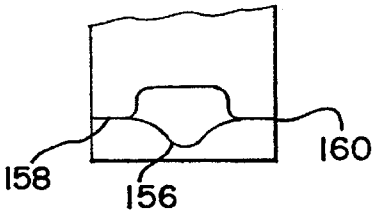
FIG. 8C is a fragmentary front elevational view of the applicator depicted in FIG. 8A.

The applicators 152 and 154 are each provided with a recessed pocket 156 (as best shown in FIGS. 8A–8C). The recessed pocket is configured to fit the knee portions 27 and 29 of the rail clip 22. Furthermore, the applicators 152 and 154 are configured with shoulder contact surfaces 158 and 160. The shoulder contact surfaces 158 and 160 are configured to contact the shoulder 20 when the rail clip 22 is positioned properly in the shoulder 20 and in engagement with the rail 16.

FIG. 8A is an isolated side view of an applicator 154 showing the positions of the recessed pocket 156 and a shoulder contact surface 158. FIG. 8B is underside view of the applicator 154 showing the shapes of the recessed pocket 156 and shoulder contact regions 158, 160. FIG. 8C is a front view of a lower portion of the applicator 154 illustrating the recessed pocket 156 and shoulder contact surfaces 158, 160.

The shafts 74 and 76 of the rail clip installer are equipped with pressure switches (not shown) which sense contact between the shoulder contact surfaces 158 and 160 the shoulder 20 and send a "down" signal to the master controller 130, stopping the downward vertical movement of the shafts 74 and 76.

In operation, when the rail clips are to be applied, the railway maintenance machine 12 is driven into position by the operator. The rail clip installer 110, in the "work up" position is positioned over a rail clip 22 using the joystick 40 to adjust the position of the spotting carriage 62. When the rail clip installer 110 is in place, the operator places the shafts 74 and 76 and guide rods 82 and 84 into the "ready" position by triggering the hand controller trigger 42.

Figure 9A:
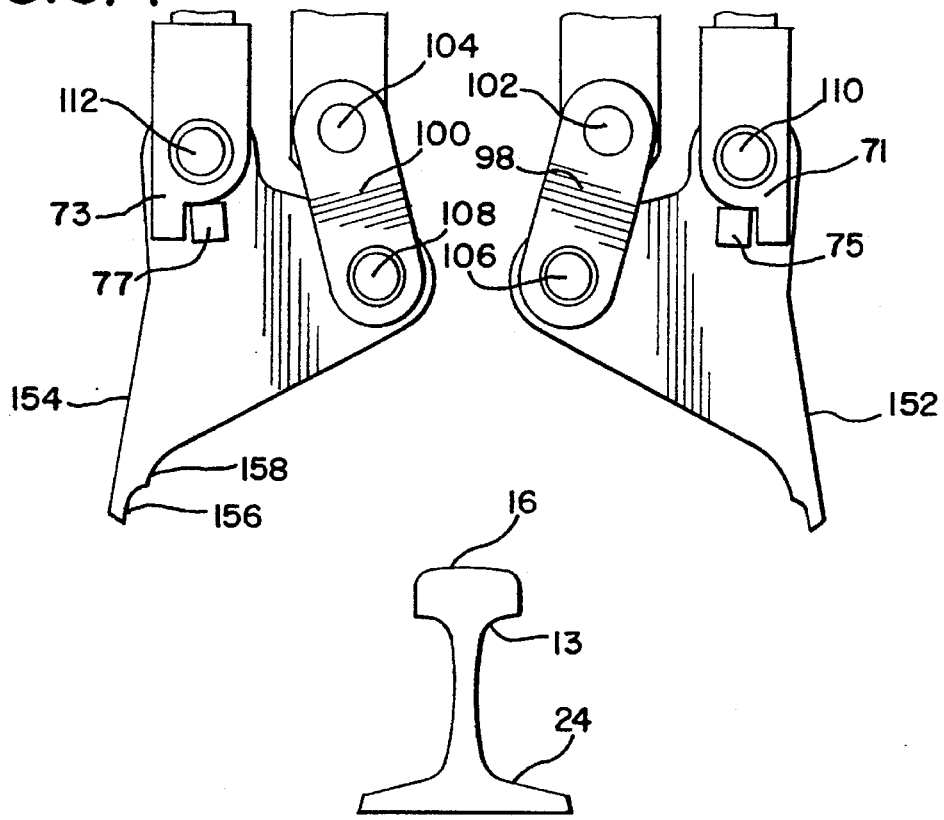
FIGS. 9A–9D are schematic views of a sectional view of a rail with a rail clip illustrating the "work up", "ready" and "down" positions of the applicator of the present invention.
Figure 9B:
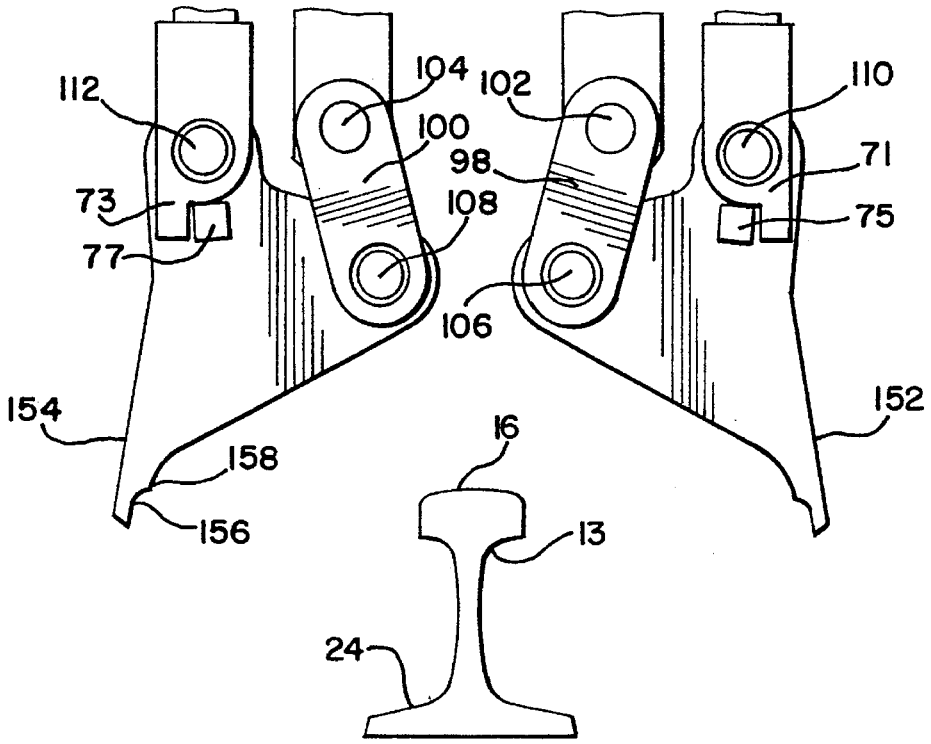
Figure 9C:
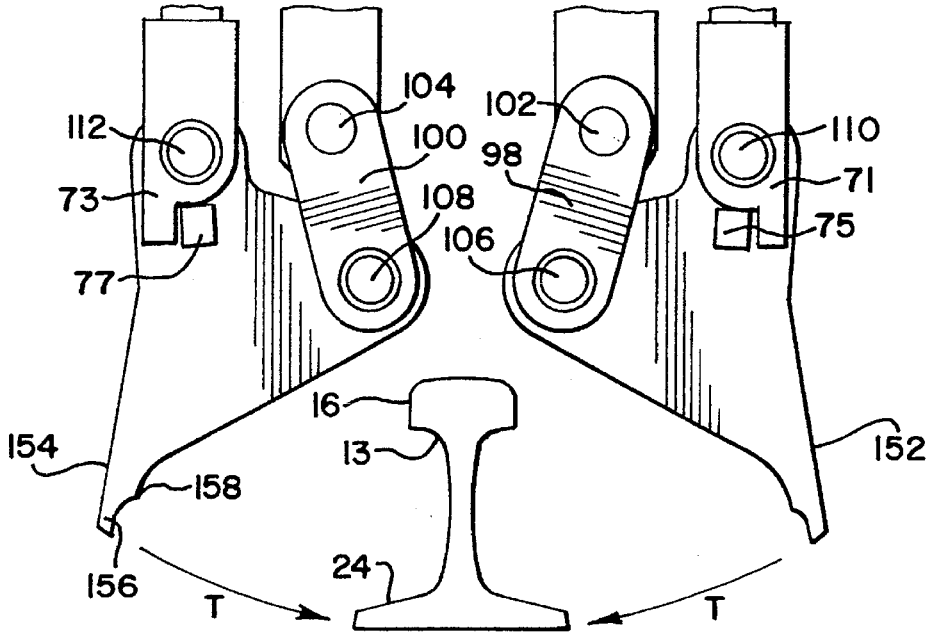
Figure 9D:
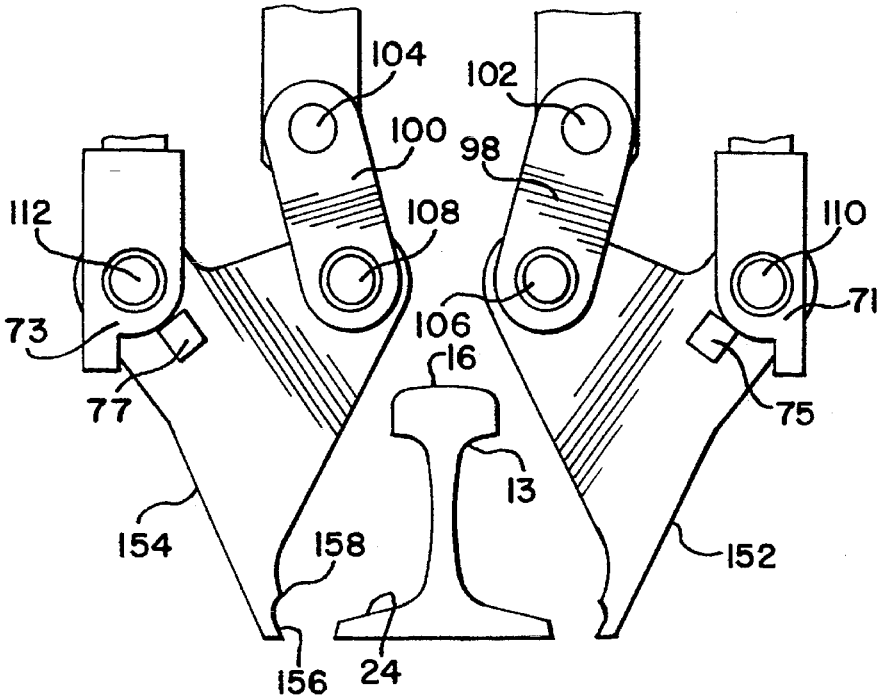

The proximity switches 118 and 120 monitor and control the disposition of the shafts 74 and 76 and the guide rods 82 and 84 between the "work up" position (best shown in FIG. 9A) and the "ready" position (best shown in FIG. 9B). This is accomplished by reading magnetic fields created by the sensor arms 122 and 124. The switches 118 and 120 sense when the upper ends 126 and 128 of the sensor arms 122 and 124 pass the switches 118 and 120. When the switches 118 and 120 detect the upper ends 126 and 128 of the sensor arms 122 and 124, the switches 118 and 120 send a "ready" signal to the master controller 130 which stops and holds the shafts 74 and 76 and the guide rods 82 and 84 in the "ready" position.

Once the rail clip installer 110 is in the "ready" position, its position may again be adjusted using the joystick 40 to adjust the position of the spotting carriage 62. When the operator is satisfied that the rail clip installer 110 is properly positioned, he initiates the installation operation by actuating one of the buttons 44 on the joystick 40, which causes the cylinders 70 and 72 to extend the shafts 74 and 76 and guide rods 82 and 84 into the "down" position. During this portion of clip installation process, the optional rail clamp 60 secures the frame 32 to the rail 16.

The guide rods 82 and 84 reach a lowermost "down" position (best shown in FIG. 9C) when the guide rod stops 83 and 85 contact the sleeves 94 and 96, stopping the guide rods 82 and 84. At this point, the shafts 74 and 76 continue to move vertically downward to their eventual lowermost "down" position (best shown in FIG. 9D).

The links 98 and 100 are configured to cause the applicators 152 and 154 to reciprocate in the generally flat arc T in a direction towards, and transverse to the longitudinal axis of the rail 16, when the guide rods 82 and 84 are in the stopped "down" position, and the shafts 74 and 76 are moving vertically downward. The hook ends 79 and 81 of the applicators 152 and 154 are configured to come into contact with the knee portions 27 and 29 of the clips 22, and the recessed pockets 156 engage the rail clips 22. The applicators 152 and 154 continue in a direction towards the rail 16, sliding the clips 22 towards, and into engagement with, the rail base 24. When the shoulder contact surfaces 158 and 160 engage the shoulders 20, the installation operation is complete, and a pressure switch (not shown) releases the downward force of the cylinders 70, 72.

After the rail clips 22 have been installed, the shafts 74 and 76, and the guide rods 82 and 84 are retracted to the "ready" position, and the rail clamp 60 is released from the rail 16. The operator then repositions the railway maintenance machine 12 over the next rail clips 22 to repeat the clip installation operation.

Figure 10:
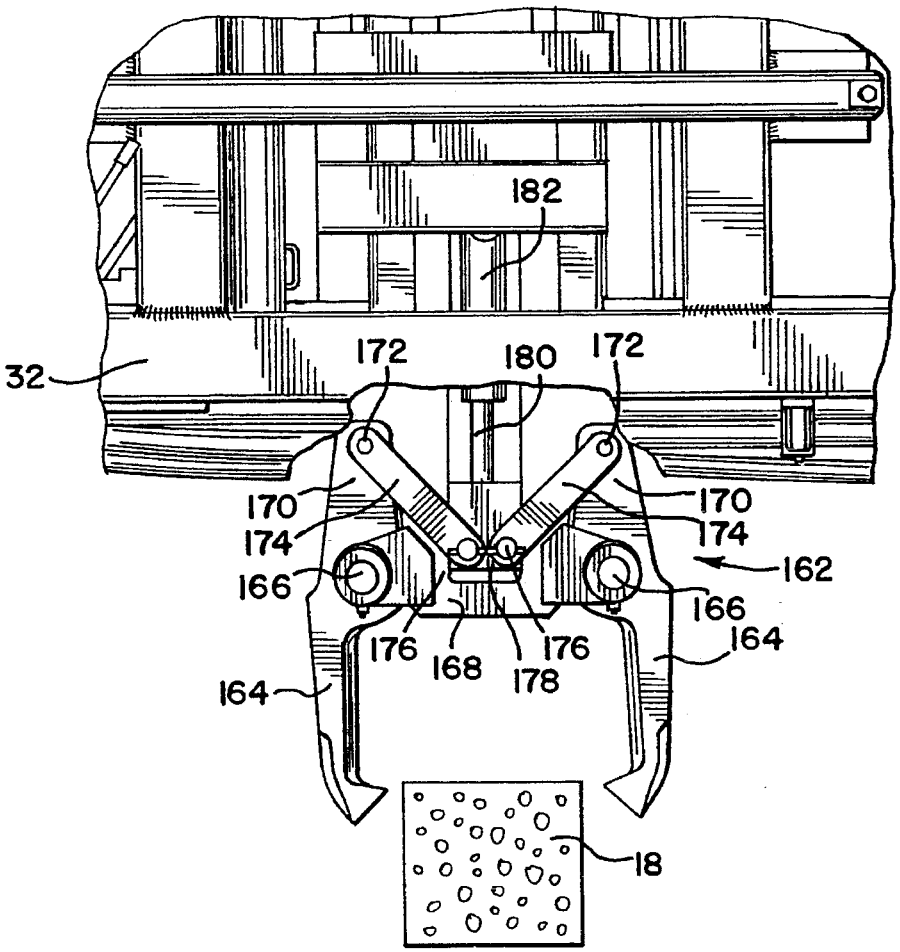
FIG. 10 is a front elevational view of a tie nipper of the type which is suitable for use with the present apparatus.

Referring now to FIG. 10, if desired, whether in either the clip installation or the clip removal modes, the present rail applicator/remover 10 may be provided with a rail nipper, generally designated 162. The assembly 162 is connected to the frame 32 and is used to securely grasp the tie 18 while the rail clip application/removal operations are being conducted. In addition, the nipper assembly 162 secures the base unit 12 to the rail 16 and prevents unwanted vertical movement thereof. The nipper assembly 162 is also useful in pulling the tie toward the base unit for more accurate clip application or removal. This is because in some cases the concrete ties have been known to settle in the ballast below a desired level. When encountering such settled ties, the operation of application or removal of clips becomes more difficult, in that the applicator/remover 10 cannot be properly aligned relative to the clip.

The assembly 162 includes a pair of nipper jaws 164 each having a centrally located main pivot axis 166 pivoting about a nipper mounting 168. A rear lobe 170 of each nipper jaw has a pivot pin 172 which connects the jaw to one end of a tie bar 174. The opposite end of the tie bar 174 is connected to a pivot pin 176 and to a block 178. A shaft 180 of a fluid power (preferably hydraulic) cylinder 182 is connected to the block 178. As the shaft is extended downwardly, the tie bars pull the jaws 164 away from the tie 18. As the shaft 180 is retracted, the jaws 164 are closed about the tie to hold the base unit 12 relative thereto in clamping relationship.

In order to speed the installation of rail clips, it is contemplated that in some applications two rail clip installers 110 may be provided on each side of the railway maintenance machine 12 so that the rail clips 22 on both sides of a tie 18 may be installed simultaneously.

While particular embodiments of the rail clip installer/remover of the invention have been shown and described, it will be appreciated by those skilled in the art that changes and modifications may be made thereto without departing from the invention in its broader aspects and as set forth in the following claims.

What is claimed is:

1. A rail clip installer configured for connection to a vehicle for installing transverse mount rail clips onto a rail, the rail having a gage side and a field side, said rail clip installer comprising:

at least one clip applicator;

at least one actuator having a substantially vertical reciprocating output shaft operably connected to said applicator for reciprocating said applicator relative to the rail; and at least one guide rod operably connected to said actuator and being disposed between said actuator and the rail for guiding said reciprocation of said shaft, said rod being pivotally connected to said applicator for translating the substantially vertical motion of said output shaft into substantially horizontal reciprocating motion of said applicator transverse to the rail.

2. The rail clip installer according to claim 1 wherein said actuator is a fluid power cylinder, and further including at least one control means for monitoring and controlling vertical displacement of said cylinder.

3. The rail clip installer according to claim 2 wherein said control means includes at least one switch arm operably connected to a shaft of said cylinder and configured to vertically reciprocate with said shaft; and at least one proximity switch configured to sense a position of said switch arm and produce a corresponding signal.

4. The rail clip installer according to claim 1 further comprising at least one guide rod stop for stopping said at least one guide rod in a "down" position, said at least one guide is operably connected to said applicator at a pivot point by a link and pivot pin so that said applicator rotates about said pivot point when said guide rod is stopped and said cylinder reciprocates, thus moving said applicator transversely to the rail.

5. The rail clip installer according to claim 1 wherein said applicator includes a recessed pocket formed to receive and hold said rail clip when said applicator is installing said rail clip.

6. The rail clip installer according to claim 1 wherein said applicator includes a contact surface for contacting a shoulder embedded in said tie when said rail clip is installed in a proper position and for stopping said transverse actuation of said applicator.

7. The rail clip installer according to claim 1 wherein said actuator is a fluid power cylinder configured for vertical reciprocation relative to the rail.

8. The rail clip installer according to claim 1 wherein:

said at least one clip applicator comprises a gage side applicator and a field side applicator;

said at least one actuator comprises a gage side actuator and a field side actuator; and said at least one guide rod comprises a gage side guide rod and a field side guide rod.

9. The apparatus according to claim 1 further including a tie nipper assembly adapted to be connected to said vehicle for grasping a rail tie.

10. A rail clip removing apparatus configured for connection to a vehicle for removing rail clips from a rail, the rail having a gage side and a field side, the rail clip remover comprising:

a gage side clip remover and a field side clip remover for removing rail clips on the gage side and field side of said rail respectively;

a gage side actuator and field side actuator, said actuators operably connected to said respective clip removers for reciprocating said clip removers;

a gage side guide rod, and a field side guide rod, said guide rods operably connected to said respective actuators so that said gage side actuator is disposed between said gage side guide rod and the rail, and said field side actuator is disposed between said field side guide rod and the rail, said guide rods being constructed and arranged for guiding said reciprocation of said actuators;

a first guide rod stop for stopping said gage side guide rod in a down position, and a second guide rod stop for stopping said field side guide rod in a down position;

said gage side guide rod and said field side guide rod being operably connected to their respective clip removers at a pivot point by a link and pivot pin so that said clip removers rotate about said respective pivot points when said guide rods are stopped and said actuators reciprocate, thus moving said clip removers transversely to the rail; and a gage side deflector block located between said gage side remover and the rail and a field side deflector block located between said field side remover and the rail, said deflector blocks being configured for preventing said removers from contacting the rail.

11. The rail clip removing apparatus according to claim 10 wherein said actuators are fluid power cylinders configured for vertical reciprocation relative to the rail.

12. The apparatus according to claim 10 further including a tie nipper assembly adapted to be connected to said vehicle for grasping a rail tie.

13. A rail clip installer configured for connection to a vehicle for installing transverse mount rail clips onto a rail, the rail having a gage side and a field side, said rail clip installer comprising:

at least one clip applicator;

at least one actuator having a substantially vertical reciprocating output shaft operably connected to said applicator for reciprocating said applicator relative to the rail;

at least one guide rod operably connected to said actuator and being disposed between said actuator and the rail for guiding said reciprocation of said shaft and pivotally connected to said applicator for translating the substantially vertical motion of said output shaft into a substantially horizontal reciprocating motion of said applicator transverse to the rail; and at least one guide rod stop for stopping said at least one guide rod in a down position, said at least one guide being operably connected to said applicator at a pivot point by a link and pivot pin so that said applicator rotates about said pivot point when said guide rod is stopped and said cylinder reciprocates, thus moving said applicator transversely to the rail.

* * * * *